United States Patent [19]

Chun

[11] Patent Number: 4,885,844

[45] Date of Patent: Dec. 12, 1989

[54] COMPUTER AIDED CUSTOM TAILORING WITH DISPOSABLE MEASUREMENT CLOTHING

[76] Inventor: Joong H. Chun, 5205 Brougham Ln., Plano, Tex. 75023

[21] Appl. No.: 271,013

[22] Filed: Nov. 14, 1988

[51] Int. Cl.[4] ..... A41H 1/02

[52] U.S. Cl. ..... 33/15; 223/68

[58] Field of Search ..... 33/11, 15, 17 R, 17 A, 33/2; 364/470, 900, 192; 223/68

[56] References Cited

U.S. PATENT DOCUMENTS

| | | | |
|---|---|---|---|
| 3,734,362 | 5/1973 | Arthur | 223/68 |
| 3,902,182 | 8/1975 | Hillborg | 33/17 R X |
| 4,598,376 | 7/1986 | Burton et al. | 33/17 A X |
| 4,635,367 | 1/1987 | Vigede | 33/15 |

FOREIGN PATENT DOCUMENTS

| | | | |
|---|---|---|---|
| 289384 | 10/1931 | Italy | 33/2 R |
| 50711 | 4/1932 | Norway | 33/17 R |

*Primary Examiner*—Harry N. Haroian

*Attorney, Agent, or Firm*—James L. Jackson & Assoc.

[57] ABSTRACT

Apparatus permitting factory tailored manufacture of clothing includes a body covering having measurement tapes which are worn by a person undergoing body measurement. Apparatus is also provided to measure crotch and armpit dimensions. The body dimensions of the person being measured are then inspected by a video camera having an output through a video cassette recorder and a computer capable of transmitting measurement date electronically to a remote location where it is received by receiving computer apparatus that converts the measurement signals to a wire frame representation of the exact body dimensions of the person. These body dimensions are then utilized for adjustment of an adjustable mannequin to the exact body dimensions of the person being measured. Thereafter, clothing is tailored to the adjustable mannequin and can then be delivered to the person without any necessity for additional adjustment.

17 Claims, 2 Drawing Sheets

FIG. 5
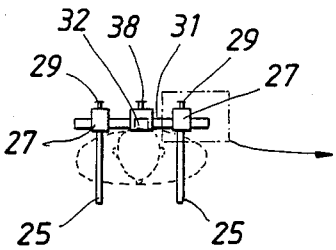
FIG. 6
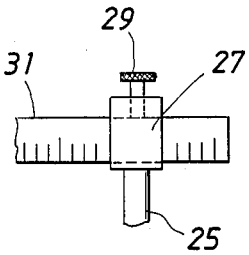
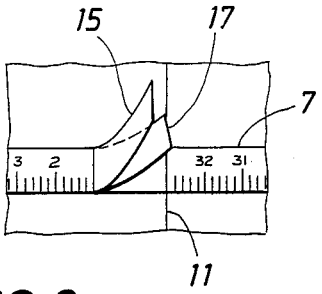
FIG. 3
FIG. 1
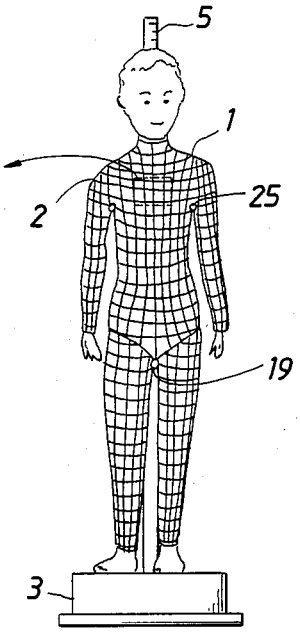
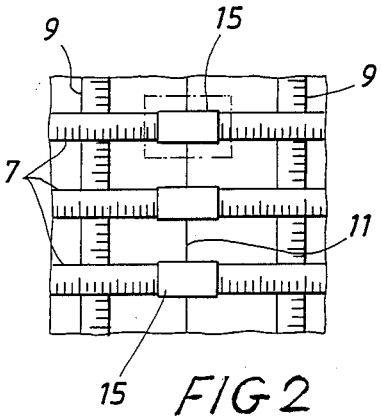
FIG 2
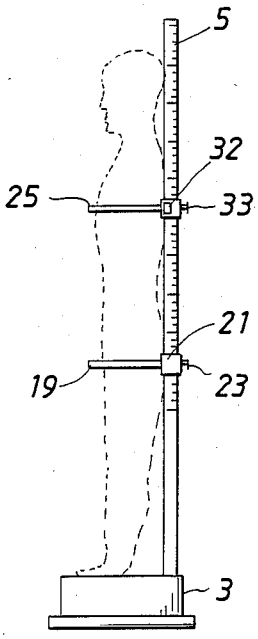
FIG. 4
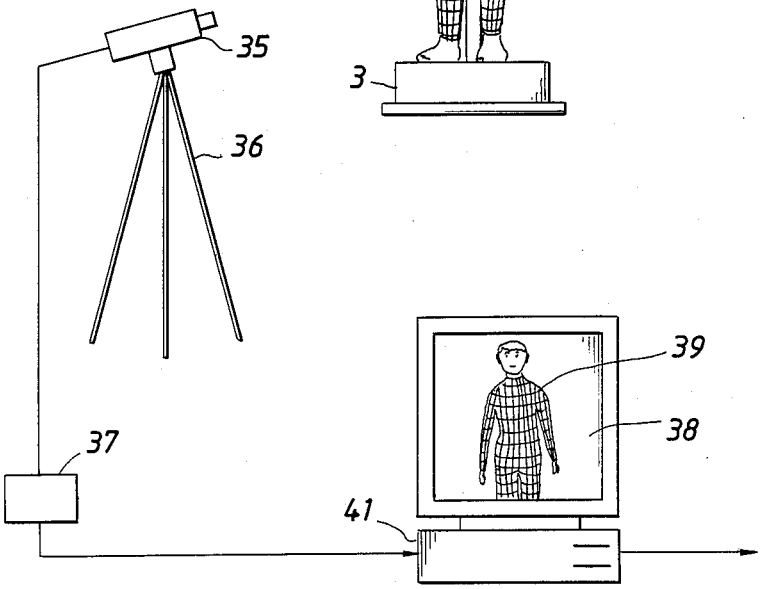
FIG. 7

FIG. 11
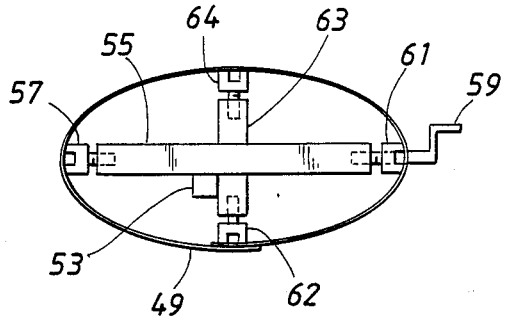
FIG. 10
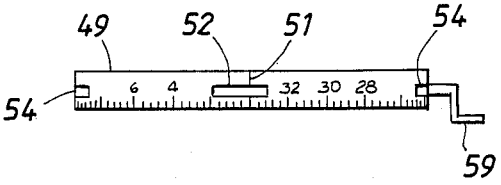
FIG. 13
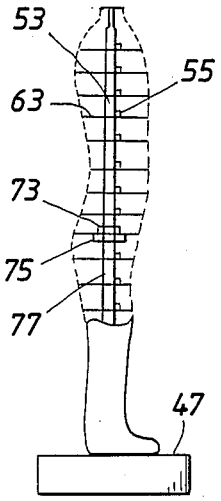
FIG. 12
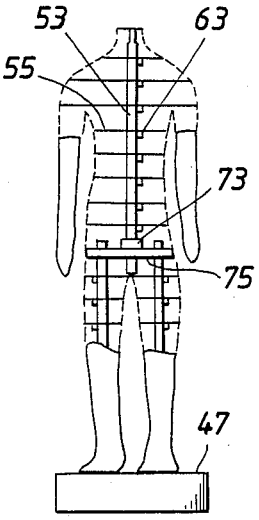
FIG. 9
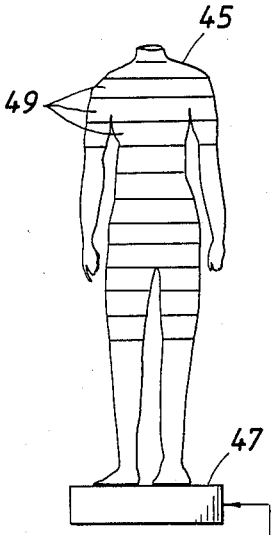
FIG. 14
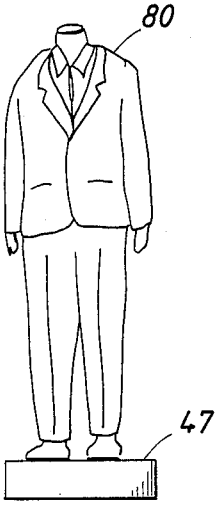
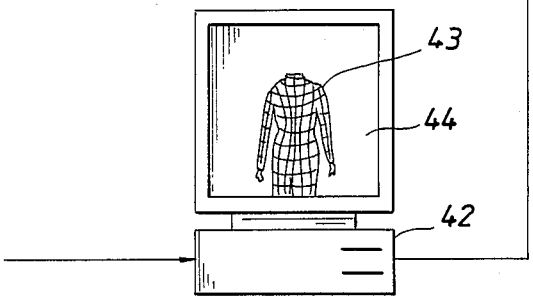
FIG. 8

COMPUTER AIDED CUSTOM TAILORING WITH DISPOSABLE MEASUREMENT CLOTHING

FIELD OF THE INVENTION

This invention relates generally to the tailoring of clothing, especially suits for men and women. More particularly, the present invention is directed to a tailoring system for clothing utilizing a computer aided tailoring system with the body measurements of individuals being accomplished by means of a disposable form fitting body suit designed for achieving accurate measurement.

BACKGROUND OF THE INVENTION

Currently, the majority of clothing sold in retail stores is mass produced in factories with the clothing being manufactured to limited standardized sizes. It is well known that the human body has a very delineated shape and that no two persons have an identical shape or body configuration. Consequently it is almost impossible to provide well fitted clothing that is completely acceptable to each customer through the use of several pre-set standardized clothing sizes and without any alterations when the clothing reaches the customer. For the retail distribution of other than tailored clothing, it is typical for retail establishments to fit each customer with clothing of an approximate size. Rarely does the clothing precisely fit the particular body configuration of the customer. Professional clothing salesmen will then typically mark the clothing for alteration and the clothing will be sent to a tailoring shop for adjustment. Thereafter, the customer must return to the retail establishment to pick up the clothing. At that time, the customer will typically put on the clothing to have the clothing inspected in its finished form to insure that proper tailoring adjustments have been made. In cases where the measuring or tailoring functions were inaccurate, the clothing at times will be sent back to the tailoring shop a second time for further adjustment. This is obviously a cumbersome, time consuming and expensive task.

In order to eliminate this cumbersome alteration process and to produce a better fitting factory manufactured clothing, it is necessary to provide an accurate measurement of the physical body configuration of each customer prior to manufacture of the clothing. Clothing that is made based on the actual measurements of each customer is commonly referred to as custom tailoring. One of the problems with custom tailoring is that it is not typically suitable for mass production and thus custom tailored clothing is much more expensive than factory manufactured, mass produced, ready to wear clothing. The hand labor that is required during fitting and custom manufacturing of the clothing typically increases the price of custom tailored clothing well beyond a price range that is suitable for the average customer.

The main difference between the refitting of factory manufactured ready to wear clothing and custom tailoring is that the measurement of the customer's body is done after the clothes are manufactured in the former case while the same is done before the clothes are made in the latter case. However, one common factor between these two approaches is the necessity of the presence of the customer at least once in order to either refit the clothing in the retail store or to measure the body configuration of the customer in a custom tailoring shop.

The conventional body measurement method commonly employed by tailors comprises the taking of a series of measurements around the customer's body utilizing a few different types of flexible tape measures. One of the problems of this method is that each measurement taken is almost independent of each other and the location of each measurement referenced to a particular portion of the body is not exact and it sometimes varies from one tailor to another.

In addition, each measurement is mostly in terms of length (inches or centimeters) and it lacks information pertaining to the shape or curvature of the body contour. Consequently, it is difficult to reproduce the exact shape and dimension of a customer's body at a clothing factory with the tailor provided measurements alone. More advanced manual measurement techniques utilize specially designed measuring devices with adjustable curvatures in order to measure delicate body contours more accurately. This measurement is usually done in the retail shop by a highly trained person and 50–100 measurements are often needed to describe the shape of a customer in detail. Although this method is very cumbersome and time consuming, it retains information pertaining to the curvature of most of body contours and thus it is far superior than the former method. However, the measurements provided by the latter method are still insufficient for the reconstruction of the exact shape of the customer's body in the factory simply because each measurement provided is almost independent to each other and information pertaining to the inter-relationship between the various body contours is lacking. One of the best methods of representing a three dimensional object with a series of contour lines is the use of a wire frame technique. This technique preserves the exact relationship between and each contour line which defines a three-dimensional object. The present invention utilizes the concept of the three-dimensional wire frame technique and thus enables the reconstruction of a customer body image almost perfectly at a remote factory utilizing the information provided by a tailor in a retail shop.

It is a principal feature of the present invention, therefore, to provide a system for accomplishing substantial mass production of clothing, which clothing is enabled to be accurately manufactured to the specific body dimensions of individual customers, thereby eliminating the need for alteration when the clothing is received by the customer.

It is also a feature of the present invention to provide a system whereby the body measurements of customers are taken by a computer and thereafter may be utilized directly or sent to a factory by suitable telemetry to thereby provide the clothing factory with the immediate capability for manufacturing clothing to the specific body measurements of the customer.

It is an even further feature of this invention to provide a novel system for tailoring clothing for customers, whereby a unique disposable body suit may be worn by the customer, which body suit is provided with a multiplicity of measurement indicia, thereby enabling the body dimensions of the customer to be measured by means of a video system, computerized and then provided to a clothing manufacturer to thus enable accurate and efficient manufacture of clothing to the specific body dimensions of the customer.

SUMMARY OF THE INVENTION

The present invention is directed to the mass production of ready to wear, custom tailored clothing in a clothing factory which does not require refitting or alteration when the clothing is delivered to the customer directly or by a retail clothing establishment. This is accomplished by providing a tailor in the clothing factory with an adjustable mannequin which has the capability of almost a perfect reproduction of each customer's body dimensions utilizing modern technology such as video cameras, personal computers, telecommunication devices, etc.

According to the general procedure of the present invention, a customer will visit a retail establishment capable of carrying out the principals of the invention and will put on a disposable measurement suit which may be composed of any one of a number of suitable materials such as paper, vinyl, etc. A series of equally spaced horizontal and vertical lines are printed on the disposable measurement suit. A scale is printed on each of the lines such that each of the lines itself becomes a measuring device such as a ruler. Thus, the wearing of the disposable measurement suit is equivalent to covering the entire body with tape rulers. Therefore, a two-dimensional picture (image) of a person wearing this measurement suit is actually the same as a wire frame drawing which is one of the best means of presenting a three dimensional object in two dimensions. Pictures of a person wearing the disposable measurement suit are taken utilizing a video camera and a complete measurement (wire frame drawing) of the customer is recorded on video tape. Numerical values of measurements are then keyed into the software of a personal computer in the retail store. Both the video image and digitized measurement (model parameters) are immediately transmitted to a computer in the clothing factory through a telecommunication line. These model parameters are fed into an adjustable mannequin and the exact shape of each customer's body is then reproduced at the factory, thus permitting factory personnel to then manufacture the clothing and at the same time, tailor it precisely to the body measurements of the customer.

The availability of a mannequin which is a perfect reproduction of a customer's body is equivalent to the presence of the customer in the factory and the availability of the customer to the tailor of the factory on a 24 hour basis for the purpose of fitting the clothing to the body parameters of the customer. Since a duplicate of the body parameters of the customer is available at the factory, the tailor can fit the semi-finished clothing to the mannequin according to the tailor's time schedule to accomplish the final fitting needed to then produce finished, properly sized clothing at the factory. There can thus be manufactured at a factory environment, which may be located anywhere in the world, tailor made custom tailored clothing which does not require any refitting or alteration when the clothing reaches the retail store for delivery to the customer.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments. In the Drawings:

FIG. 1 is an elevational view showing a person standing on a rotatable measurement stand and wearing a disposable body measurement suit constructed in accordance with the principles of the present invention.

FIG. 2 is an enlarged elevational view of a portion of the body measurement suit of FIG. 1 in detail.

FIG. 3 is a fragmentary elevational view of a portion of the body measurement suit shown in FIGS. 1 and 2 and further illustrating the details of construction thereof.

FIG. 4 is a side view of the rotatable measurement stand of FIG. 1, illustrating the measurement stand in full line and showing a person being measured by way of broken lines.

FIG. 5 is a plan view of the body measurement stand of FIG. 4.

FIG. 6 is a fragmentary plan view of the body measurements stand of FIG. 5, illustrating certain structural details thereof.

FIG. 7 is a diagrammatic illustration of a video camera and video monitoring system with a personal computer (P/C) that is utilized in the measuring and displaying of the body configuration of the person.

FIG. 8 is a graphical illustration of a computer and video monitor at a location remote from the apparatus of FIG. 7 and which provides an output circuit for delivery of output signals to an adjustable mannequin.

FIG. 9 is an elevational view showing an adjustable mannequin constructed in accordance with the present invention.

FIG. 10 is a partial elevational view of the adjustable mannequin of FIG. 9, showing a circumferentially adjustable elastic band forming an adjustable section of the mannequin of FIG. 9.

FIG. 11 is a cross-sectional view of the adjustable band of FIG. 10.

FIG. 12 is a front elevational view of the skeleton of the adjustable mannequin of FIG. 9.

FIG. 13 is a side view of the skeleton of the adjustable skeleton.

FIG. 14 is an elevational view showing finished clothing that is sized to the particular adjustments of the mannequin that are controlled by the computer system.

DETAILED DESCRIPTION OF THE PREFERRED EMBODIMENT

Referring now to the drawings, those aspects of the invention which relate to operations that are conducted at a retail establishment or the like are depicted in FIGS. 1–7 while those aspects of the invention that relate to manufacture of the clothing are depicted in FIGS. 8–14. As this invention is explained in detail, it will become evident that the aspects of the invention shown in FIGS. 8–14 may be located at significant distances from those aspects shown in FIGS. 1–7. For example, a clothing manufacturer in one country may effectively deal with a retailer in another country in the design and manufacture of clothing. The only difference that would occur would be in the distance for actual shipping of the finished goods from the manufacturer to the retailer of the customer.

As shown in FIG. 1, a customer 1 who will be wearing a body measurement suit described in detail hereinbelow, will stand on the upper platform of a rotatable measurement stand 3. The rotatable measurement stand 3 is provided at its rear portion with a vertical measurement pole or standard 5 which is fairly similar to the height measurement stand typically found in a doctor's office for measurement of the height of medical patients. For crotch measurements, the rotatable measurement stand is provided with a horizontally extending crotch rest 19 which is firmly connected to a rectangular slide member 21. A screw lock device 23 having a manually operable knob is supported by the slide 21 and is utilized to lock the slide in immovable relation to the vertical pole 5. Likewise, the apparatus includes a pair of laterally extending arm pit rests 25 that are respectively connected perpendicularly to a rectangular horizontal slide member S2 similar to that shown at 21. Slide member 32 is also provided with a locking screw 33 having a manually engageable knob for locking the slide 32 relative to the pole 5 or permitting the slide to have vertical movement relative to the pole.

With reference to FIG. 2, a small portion of the front section of a disposable measurement suit is shown in detail. The disposable measurement suit 2 is provided with equally spaced horizontal lines each provided with a printed scale such as shown at 7 in FIG. 2. As shown at 9 in FIG. 2, the disposable measurement suit is also provided with spaced vertical lines or tapes each having a printed scale in the manner shown. Reference 11 depicts the left side edge of the cloth or material of the disposable measurement suit which overlaps the right side of the cloth. A plurality of retaining tabs or other devices 15 are provided which connect and hold the left and right sides of the disposable measurement suit in assembly. The function of the retaining devices 15 is similar to that of buttons and/or zippers. A product sold under the registered trademark "Velcro" may be effectively utilized for the retaining devices 15.

FIG. 3 is an enlarged illustration of a taping mechanism of the disposable measurement suit prior to sticking the tape. The adhesive side of the tape 15 is covered by means of a tape cover 17. The tape system 15 and 17 is similar to the tape utilized for securing disposable baby diapers about the pelvic region of an infant. As can be seen in FIG. 3, one side of the tape is prefixed to the cloth and the other side is covered by tape cover 17. In order to fit the disposable measurement suit to the customer, a cloth fitter in the retail store will peel away the tape cover 17 and attache the tape 15 for each contour line. After the taping operation has been completed for all of the tapes attached to the disposable measurement suit, the fitting is completed. At this time, obviously the disposable measurement suit will fit in substantially skin-tight relation about the body of the customer. It should be pointed out that ten or twenty different general size disposable measurement suits will be made available to each store in order to make the fitting process easier for the clothing fitter. After the fitting has been completed, the numerical value of the circumference of each of the contours is directly readable as shown in FIG. 3. This is because the numerical values of the scale is printed on each of the contour tapes and is thereby directly readable by personnel doing the fitting. The indicia set forth on the measurement tapes is also clearly readable by means of a video system to be discussed hereinbelow which provides output signals that are transmitted via any suitable telemetry to a signal receiving facility at a remote location, i.e., the clothing factory.

A side view of the rotatable measurement stand is depicted in FIG. 4 showing in full lines the relationship of the crotch rest 19 and the armpit rests 25 in relation to the customer shown in broken lines. With the customer standing erect, the crotch rest and armpit rests are adjusted such that they fit snugly with the customer. The vertical post 5 is provided with indicia which is read in comparison to the respective positions of the slide elements 21 and 32 to thus establish certain height parameters of the customer. Obviously, the locking screws 23 and 33 are utilized to secure the respective crotch and armpit rests in immovable relation to the vertical pole 5.

The armpit rests 25 shown in FIGS. 1 and 4 have a similar mechanism as the crotch rest system and the top view of the armpit rest system is depicted in FIG. 5. A horizontal bar 31 is formed to define a rectangular aperture 32 at its central portion to allow the height measurement pole 5 to be extended through the rectangular aperture. Thus horizontal bar 31 slides up and down vertically along the vertical pole 5. The locking screw 33 or other suitable locking assembly is utilized to secure the bar 31 relative to the vertical pole 5. Each of the armpit rests 25 are provided with rectangular slide members 27 having rectangular apertures within which the end portions of the horizontal bar 31 are received. Respective locking screws 29 are utilized to secure the slide member 27 in fixed relation with the horizontal bar. These features are illustrated in greater detail in FIG. 6, which shows the horizontal bar 31 to have measurement indicia thereon to thus enable the direct reading of certain body parameters of the customer by virtue of positioning of the armpit rests 25. The screw bar 33 is placed in the back of the rectangular aperture 32 to hold the armpit rest system bar 31 in fixed relation to the vertical pole 5 when the system is properly positioned as shown in FIG. 4. As shown in FIG. 5, at both ends of the horizontal bar 31, the armpit rests 27 are attached with slide members 27 being adjustably positionable on the horizontal bar 31 and capable of being secured in fixed relation with the bar 31 by means of the locking screws 29. The design and mechanism of the armpit rest system is the same as that of the crotch rest system and an enlarged view of the system is depicted in FIG. 6. The only difference between these two systems is that the armrest system slides along the horizontal bar 31 while the crotch rest system slides up and down vertically along the vertical post 5. As can be seen in FIGS. 5 and 6 a scale is marked on the horizontal bar 31 to show the exact distance between the vertical pole 5 and each of the armpit rests 25. The elevation of the armpits of the customer is correctly readable on the vertical measurement indicia of the vertical pole 5 as shown in FIG. 4.

The purpose of having the armpit rest and crotch rest systems is two fold, i.e., the crotch and armpit rests are used to measure the exact height and width of the armpits as well as the height of the crotch to thereby provide the tailor with these particular body measurements. The crotch and armpit rests are also utilized to steady the customer's body during the period when the rotatable body measurement support is being rotated while a video camera is being operated to inspect the various measurements of the disposable measurement suit and the body measurement.

When all of t he necessary preparations have been completed for measurement of the customer, a video recording is prepared utilizing a video camera as shown at S5 in FIG. 7 which is typically supported by means of a tripod 36 or by any other suitable support. The circuitry of the video camera also includes a video cassette recorder for the purpose of recording the video signal developed by the camera. During the recording the rotatable measurement stand 3 of FIGS. 1 and 2 is rotated to thus permit the camera to inspect and record the many different body measurements of the customer at various different angles, with the camera zooming to read various scales more clearly as needed. The recorded video image can be directly transmitted to the factory through telecommunication lines or the video tape can be mailed or otherwise shipped to the factory location.

The recorded analog video image from the video camera may be fed into the analog to digital converter 37 and the digitized image can be input to the personal computer (P/C) 41 as shown in FIG. 7. The digitized image can be stored in the disk memory in the P/C temporarily and later viewed on the graphic terminal 38 for inspection as shown in FIG. 7. In addition, vital business information such as retail store number and location, customer's name, address, fashion type, color of fabric, etc. and any special instructions for custom tailoring will be keyed into the P/C 41 and this information will be transmitted to the factory together with the digitized image. The measurements (model parameters) such as the length of the circumference of all contour lines, height and width of the armpits, height of crotch, etc. are necessary for the reconstruction of the specific body configuration of the customer at the clothing factory location. These model parameters can be extracted either in the retail store or at the factory by viewing the recorded video image. These body parameters can also be automatically extracted by processing the digitized video image utilizing modern pattern recognition techniques and high speed computers. These model parameters can also be read into a personal computer such as shown at 41 in FIG. 7, directly, utilizing an optical scanner if an optical code has been printed on each horizontal and vertical measurement line of the disposable measurement suit. Alternatively, clerical personnel at the customer measurement facility are capable of manually reading the various indicia of the disposable measurement suit and the rotatable measurement stand, which various measurements can be simply keyed into the personal computer. This recorded model parameter information whether manually keyed in, optically scanned, or automatically extracted by processing the digitized image can then be transmitted to the clothing factory through a modem or through any other suitable system for telemetry.

As soon as the factory receives the model parameter of a customer, this information can be converted to the proper size and shape for each fabric piece to be tailored by the computer automatically and this fabrication information can be fed into the automated fabrication machine which is commonly available in the modern clothing factories. The fabricated clothing will be tailored by a tailor in the factory up to the stage where it is ready for final detailed adjustment utilizing a special mannequin which is almost a perfect duplicate of the shape of the customer. This special mannequin will be described in detail hereinbelow.

As shown in FIG. 8 a wire frame drawing of a customer's body 43 is depicted on the video screen of a personal computer 42 that is set up to receive signals transmitted from the personal computer 41 of FIG. 7 which is located in the retail store. In order to check the accuracy of the various model parameters, it is desirable to compare the model parameter based reconstructed image and the video recorded image of the customer utilizing a computer. Very accurate model parameters are obtainable by minimizing the difference between these two images by adjusting the model parameters utilizing a computer system. Once model parameters are refined then these parameters will be utilized for adjustment of an adjustable mannequin shown in FIG. 9 in order to reconstruct the body configuration of the customer. An adjustable mannequin 45 is shown in FIG. 9 to be standing on a mannequin stand 47. It would be most practical if a clothing factory has perhaps ten or twenty mannequin units, each of a different general size and each being adjustable. These adjustable mannequins will permit each customer's body configuration to be accurately fitted to one of the closest sized mannequins. In this manner, the amount of adjustment of the mannequin will be minimized and proper adjustment of the mannequin relative to the body configuration of the customer will be accomplished with minimal effort and time.

Basically, an adjustable mannequin consists of a series of circumferentially adjustable elastic bands 49 as shown in FIG. 9. The front view of one of the adjustable bands of the mannequin of FIG. 9 is shown in FIG. 10. As can be seen in FIG. 10 the adjustable band is printed with indicia forming a scale that can be easily read to show the particular circumference of the band. Element 51 defines one edge of the circumferential band which overlaps the opposite end. elements 52 and 54 are respective front and side holes through which a crank shaft screwdriver 59 extends to reach the respective heads of length control bolt screws 57, 61, 62 and 64 as shown in FIG. 11. These bolt screws can be efficiently adjusted to match the dimension of the adjustable band 49 with the particular dimension of that particular section of the disposable body suit. FIG. 11 shows the cross-sectional view of a band 49. Since the shape of the human body is more or less elliptical, it is necessary to provide a mechanism to adjust both of the major and minor axis of an ellipse that represents a particular body section of the customer. The mannequin structure is provided with a vertical support 53 which has a function similar to that of the backbone of a human body. The major and minor axis defined by cross bars 55 and 63 are welded or otherwise fixed to the vertical support 53. At each end of the cross bars 55 and 63 there is provided a screw hole to accept a length adjustment bolt screw. Elements 57, 61, 62 and 64 are length adjustment bolt screws and the head of each screw is provided with a hexagonal hole to accommodate the crank shaft driver 59. By placing the driver 59 to each length adjustment screw and rotating, the length of the major and minor axis of the ellipse can be shortened or lengthened as appropriate to depict the particular body configuration of the customer as previously measured. Since the circumferential band 59 is composed of elastic material, whenever the axis is shortened then the circumferential band shrinks and the circumference of the elastic band 49 is reduced. On the other hand, if an axis is lengthened, the elastic band 49 is stretched and expanded and the circumference of the band 49 increases.

The front and side views of the skeleton of the mannequin are presented in FIGS. 12 and 13 respectively. These two figures show the structural relationship between the vertical support 53 and the cross bars 55 and 63 in clear relationship to the body structure of the mannequin.

A pair of leg poles 77 are provided as shown in FIGS. 12 and 13. The leg poles 77 are connected to a horizontal leg support bar 75 and also provide structural support for the vertical bar 53 that defines the backbone structure of the mannequin. In the central portion of the horizontal bar 75 is provided a screw hole through which the vertical support bar 53 extends and a nut 73 is utilized to secure the bar 53 in relation to the horizontal bar 75. By turning the nut 73 the height of the support bar 53 can be either raised or lowered as is appropriate to match the body parameters of the customer. The mechanism of the support bar 53 is similar to the cones used for the height of rotatable adjustable chairs.

The general operational procedures for the adjustable mannequin is as follows: for each customer, the computer 42 is utilized to provide a printout or screen display as to which size mannequin to be selected. height adjustment needed and how many turns are needed to adjust for each adjustment screw of each adjustment band 49 in order to reproduce the exact body configuration of each customer. Thus, by following the computer instructions, the mannequin adjuster at the factory location can easily reproduce the exact configuration of the body of each customer.

There are many different ways of designing the mechanism of an adjustable mannequin. In order to explain the basic concept of the adjustable mannequin, a manually adjustable design is introduced in this patent disclosure. However, it is to be born in mind that such is not limiting as regards the present invention. It is possible to design and produce a fully computer controlled automatically adjustable mannequin within the scope of currently available technology. An automated control may employ either a centralized hydraulic system or motor driven control system.

Once the mannequin is adjusted whether manually or automatically and the exact shape of a customer is reproduced, the tailor in the factory will then place semi-finished clothing on the adjusted mannequin as shown in FIG. 14. The tailor will then make a final fitting to complete t he tailoring operation. In this manner, perfectly fitting custom tailored made clothing is produced in a remotely located factory which does not require any further readjustment or alteration when the clothing reaches a retail facility for distribution to the customer.

ADVANTAGES

Currently, retail stores for clothing are required to stock large quantities of clothing in various sizes shapes and colors. The present invention eliminates the need for a retail establishment to maintain large inventories of clothing. It is necessary only to display samples in order that the customer may personally observe the character of the clothing that is intended for purchase.

The present invention eliminates the need for retail stores to maintain experienced personnel for fitting and alteration of clothing. Through use of the present invention relatively inexperienced personnel will have the capability of efficiently fitting a customer and ordering custom tailor made clothing according to the customer's specifications. The present invention provides truly custom tailor made clothing for each customer even though the clothing is manufactured at a clothing factory. Cost effective and economical mass production of custom tailoring is possible by employing the concepts of the present invention. The present invention provides flexibility of better selection of fabrics, color and style compared to ready to wear clothes. The present invention also effectively minimizes the necessity for retail establishments to sell clothing at marked down prices. Unsold ready to wear clothing in retail shops constituted waste and is one of the most significant factors which increases the overall cost of clothing. Employment of the present invention virtually eliminates this problem and consequently will render the price of custom tailored clothing to a level that is acceptable for most purchasers.

While the foregoing is directed to the preferred embodiment, the scope is determined by the claims which follow.

What is claimed is:

1. Apparatus permitting factory tailored manufacture of clothing comprising:
   (a) body covering means adapted to be worn by a person and having spaced horizontal and vertical measurement lines each marked with measurement indicia for indication of incremental body dimensions of said person;
   (b) means for establishing crotch and armpit measurements of said person from a measurement plan;
   (c) means for establishing electronic measurement signals representing body covering and crotch and armpit measurements and transmitting said measurement signals to a remote location;
   (d) means for receiving said electronic measurement signals at said remote location; and
   (e) an adjustable mannequin at said remote location being adjustable to a body configuration and size corresponding to said electronic measurement signals and permitting tailored clothing to be manufactured that will fit the person without further alteration.

2. Apparatus as recited in claim 1, wherein said body covering means comprises:
   (a) a thin suit adapted to fit said person in substantially skin tight manner and to cover the body, arms and legs of said person; and
   (b) vertical and horizontal measurement tapes being positioned in spaced relation on said suit and having said measurement indicia thereon, said measurement indicia identifying specific body dimensions at the location thereof.

3. Apparatus as recited in claim 2, wherein:
   (a) said substantially skin tight suit is split vertically along the body, arms and legs thereof; and
   (b) said vertical and horizontal measurement tapes having end tabs enabling said measurement tapes to be tightened about body parts of said person to thereby enable specific body measurements to be clearly indicated by the respective positions of said tape securing tabs.

4. Apparatus as recited in claim 1, wherein said means for establishing crotch and armpit measurements of said person comprises:
   (a) a platform establishing a flat surface on which the persons being measured stand;
   (b) a vertical post extending upwardly from said platform and having measurement indicia thereon; and
   (c) upper and lower slide elements being received by said vertical posts and being movable to measurement positions to establish said crotch and armpit measurements of said person.

5. Apparatus as recited in claim 4 wherein said platform is rotatable, thereby permitting rotation of a person being measured so that the front, rear and sides of the person can be presented for inspection.

6. Apparatus as recited in claim 4, wherein said upper and lower slide elements each have locking devices for securing the same at measurement positions.

7. Apparatus as recited in claim 4 wherein:

(a) a crotch measurement bar extends in generally horizontal relation from said lower slide element;

(b) a pair of generally horizontal bars extend from said upper slide element; and (c) a pair of armpit rest element s extend in generally horizontal relation from respective ones of said horizontal bar and are adjustable relative to said horizontal bar.

8. Apparatus as recited in claim 7, wherein:

(a) a pair of horizontal slide elements establish movable support for said armpit rest elements relative to said horizontal bars; and (b) said horizontal bars each define measurement indicia that is visible to identify respective positions of said armpit rest elements relative to said horizontal bars.

9. Apparatus as recited in claim 1 wherein said means for establishing electronic measurement signals comprises:

(a) a video camera being positionable to inspect said body covering worn by the person; and (b) means transmitting video signals of said camera to said remote location.

10. Apparatus as recited in claim 9, including a video cassette recorder adapted to record video signals of said video camera and adapted for selected transmission of video signals to said remote location.

11. Apparatus as recited in claim 9, including a computer connected to receive the signal from said video camera and to transmit said signal to said remote location.

12. Apparatus as recited in claim 9, wherein said means transmitting said video signal comprises:

(a) a video cassette recorder receiving the output of said video camera and recording the same; and (b) a computer receiving the output of said video cassette recorder and adapted to store said video signal and, upon selection, to transmit said video signal to said remote location.

13. Apparatus as recited in claim 9, including means at said remote location receiving said video signal and presenting said video signal for review.

14. Apparatus as recited in claim 9, wherein said means receiving said video signal comprises a computer at said remote location for receiving and presenting said video signal, the output of said computer being received by an adjustable mannequin mechanism, enabling adjustment of said mannequin mechanism to correspond with dimensions established by said computer signal.

15. Apparatus as recited in claim 1, wherein said adjustable mannequin comprises:

(a) a mannequin stand:

(b) a pair of vertical supports extending upwardly from said base;

(c) a horizontal support interconnected with upper portions of said vertical supports;

(d) a vertical back support extending upwardly from the central portion of said horizontal support; and (e) a plurality of body sections being adjustably interconnected with said vertical back support and said vertical leg supports, each of said body sections being adjustable for increase and decrease of the physical dimension thereof as determined by said measurement signals.

16. Apparatus as recited in claim 15 wherein each of said body sections comprises:

(a) a pair of cross members being interconnected respectively with said vertical back support and said vertical leg supports;

(b) adjustment elements being interconnected with respective extremities of said cross members; and (c) a band element being supported by said adjustment members and capable of expansion and contraction by said adjustment members for establishment of the dimension and configuration of said body band according to said measurement signals.

17. Apparatus as recited in claim 16, wherein said body band is composed of elastic material capable of expansion and contraction.

* * * * *